United States Patent [19]

Lighten

[11] Patent Number: 5,007,531

[45] Date of Patent: Apr. 16, 1991

[54] SHOWER KIT

[76] Inventor: Jimi Lighten, 5311 College Oaks Dr., No. 20, Sacramento, Calif. 95841

[21] Appl. No.: 455,093

[22] Filed: Dec. 22, 1989

[51] Int. Cl.[5] ..... A47K 5/08

[52] U.S. Cl. ..... 206/77.1; 132/315; 206/581; 206/823; 220/23.4; 220/23.8

[58] Field of Search ..... 132/315; 206/77.1, 229, 206/581, 823; 220/23.2, 23.4, 23.83, 23.86, 23.8

[56] References Cited

U.S. PATENT DOCUMENTS

| | | | |
|---|---|---|---|
| 1,027,362 | 5/1912 | Strong et al. . | |
| 1,792,582 | 2/1931 | Goldsmith . | |
| 1,998,147 | 4/1935 | Stegman | 220/23.83 |
| 2,014,822 | 9/1935 | Trachtenberg | 150/34 |
| 2,954,898 | 10/1960 | Freeberg | 220/102 |
| 3,078,016 | 2/1963 | Judy | 222/181 |
| 3,258,017 | 6/1966 | Albert | 132/79 |
| 3,653,554 | 4/1972 | Turben | 222/181 |
| 3,664,353 | 5/1972 | Childress | 132/79 |
| 3,732,955 | 5/1973 | Carter et al. | 190/51 |
| 3,842,976 | 10/1974 | Dea | 206/203 |
| 3,955,715 | 5/1976 | Topor | 222/143 |
| 4,280,643 | 7/1981 | Cordova et al. | 206/77.1 |
| 4,470,523 | 9/1984 | Spector . | |
| 4,538,727 | 9/1985 | Solloway | 206/223 |
| 4,592,478 | 6/1986 | Laconis | 206/77.1 |
| 4,919,293 | 4/1990 | Buckley | 220/23.2 |

*Primary Examiner*—Jimmy G. Foster

*Attorney, Agent, or Firm*—Joseph E. Gerber

[57] ABSTRACT

A shower kit adapted to carry a bar of soap, two liquid receptacles and a face cloth is disclosed. The kit comprises a pair of containers, each container comprising a base shell and a lid shell bound along one mating edge by a hinge, and having a clasp opposite the hinge to retain the lid shell in a closed position. One of the containers defines a pair of apertures through which the necks and caps of a pair of liquid receptacles inside the container may project. The same container also has a pair of access holes through which the liquid receptacles may be squeezed or manipulated. The other container is completely closed for carrying soap. The containers have a strap binding them together and can be folded over to bind a face cloth therebetween. A protrusion from one container permits a belt from the other to be bound thereto, thus holding the containers in folded relation with the face cloth between.

20 Claims, 4 Drawing Sheets

FIG.-2
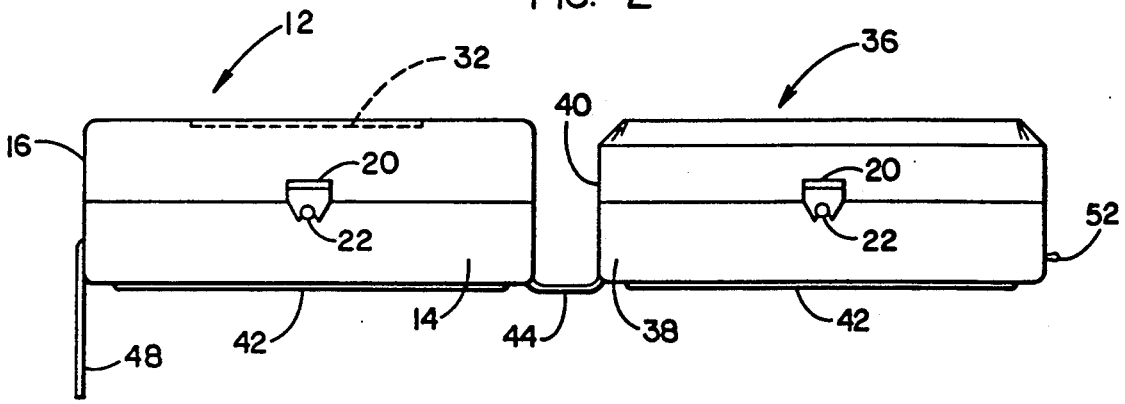
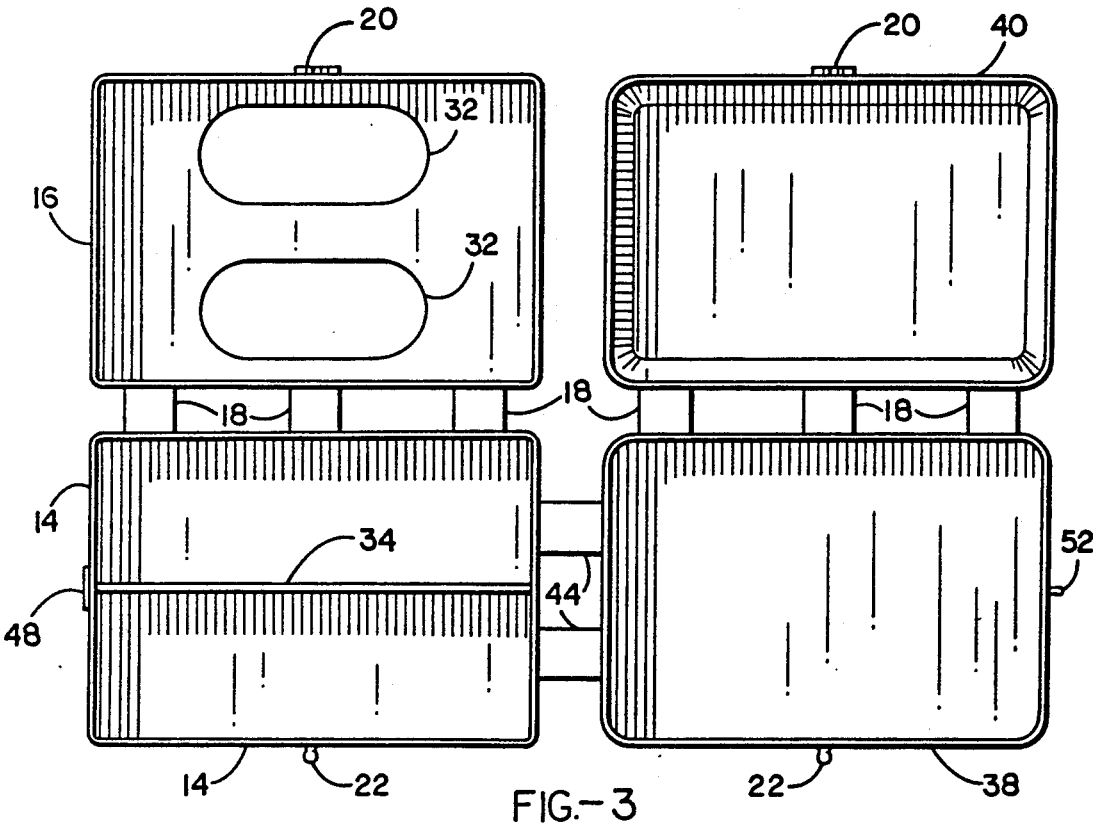
FIG.-3

FIG.- 5
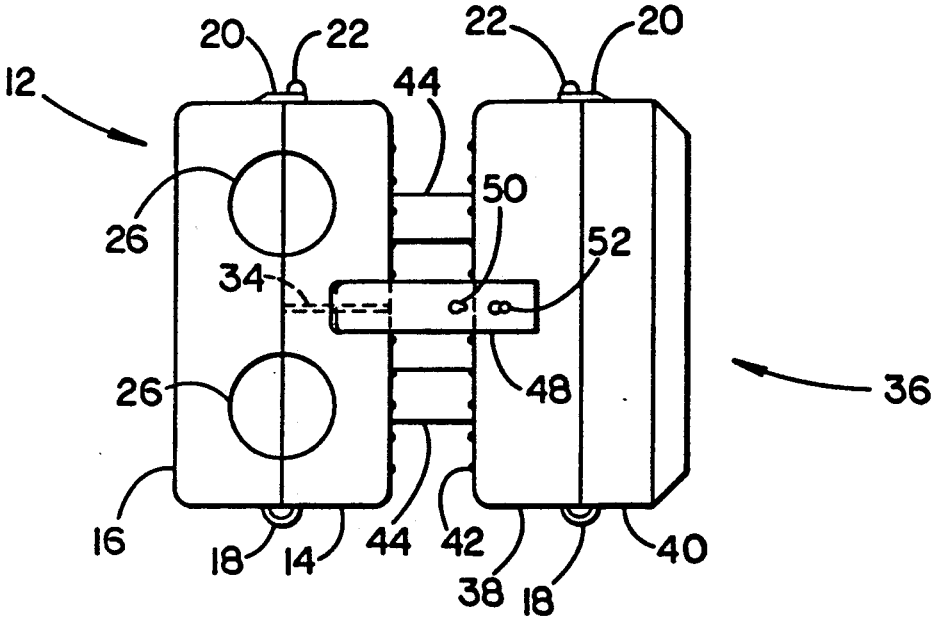
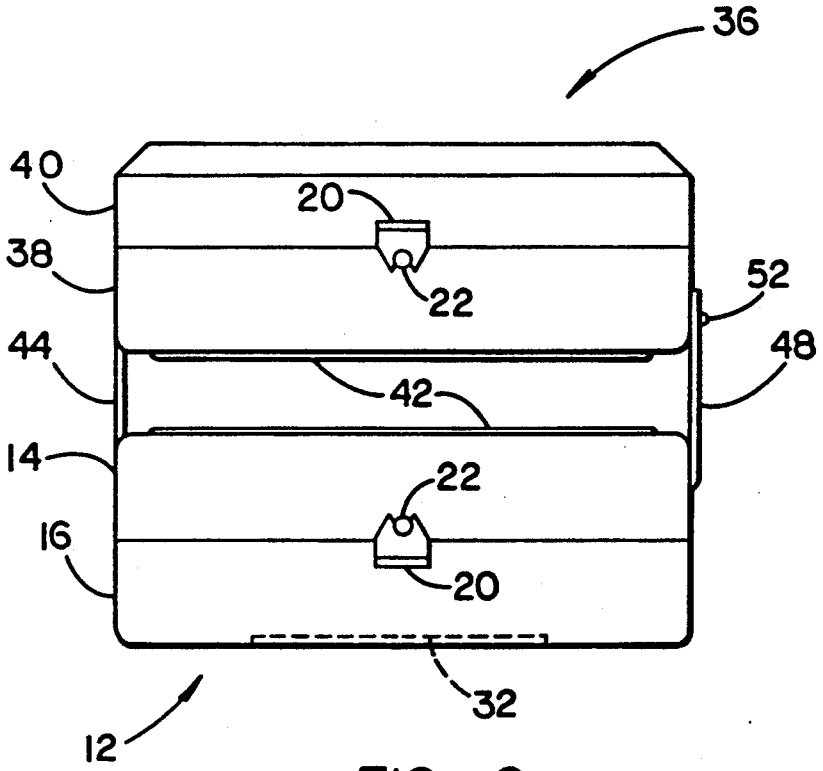
FIG.- 6

SHOWER KIT

BACKGROUND OF THE INVENTION

1. Field Of The Invention

The present invention relates generally to carrying cases for articles, and more specifically to apparatus for carrying and storing toiletries for the shower.

2. Description Of The Related Art

A vast variety of devices for carrying and storing shower toiletries is known. For example, shaving kits, ditty bags and the like are commonly employed. However, they are adapted to carrying all manner of toilet articles besides those strictly for the shower and are, therefore, often of substantial size. In addition, these are often of fabric and usually include zippers. Thus, they tend not to be designed for use directly in water.

Plastic soap boxes are another familiar item, these being more adapted to shower use. However, they usually accommodate little more than a single bar of soap.

A shower kit adapted to carry the minimum, essential shower items is needed; these being soap, hair shampoo and conditioner, and a face cloth. Further, being adapted for use right in the shower, it should be impervious to water. And, such a kit should be readily useful as a toilet article carrier outside the shower, as well. It is additionally desirable that the kit permit the face cloth to dry between uses.

SUMMARY OF THE INVENTION

The kit of the present invention is adapted to overcome the above-noted shortcomings and to fulfill the stated needs. It includes a pair of containers, each container comprising a releasably mating pair of shells defining a cavity. One or more flexible members join the containers such that one container may be folded over, or superimposed upon, the other. The flexible member is dimensioned to leave sufficient space for a face cloth between the containers when one is folded over the other. And, means for releasably binding the containers to one another while holding a face cloth therebetween is provided.

Further, at least one aperture may be defined in one of the containers through which the neck of a liquid-retaining receptacle, such as a shampoo bottle, may project. And, an access hole through which such a bottle may be manipulated, or squeezed, may be provided.

Thus, it is an object of the present invention to provide a practical, space-efficient kit for carrying only the essentials needed for showering.

It is a feature of the present invention that containers for bar soap and shampoo are flexibly bound together to retain a face cloth and expose it to drying air.

It is an advantage of the shower kit herein that it permits access to soap and shampoo containers separately, without disturbing the other.

Still further objects, features and advantages of the inventive shower kit disclosed herein will be apparent from the drawings and following detailed description thereof.

BRIEF DESCRIPTION OF THE DRAWINGS

FIG. 2 is a front elevation of the kit of FIG. 1 with its soap and shampoo containers closed.

FIG. 3 is a plan view of the inventive kit laid completely open.

FIG. 5 is an end elevation of the inventive kit with its containers closed, folded toward one another and bound in place with a space for a face cloth between them.

FIG. 6 is a front elevation of the kit configured as in FIG. 5.

DESCRIPTION OF THE PREFERRED EMBODIMENT

Figure 1:
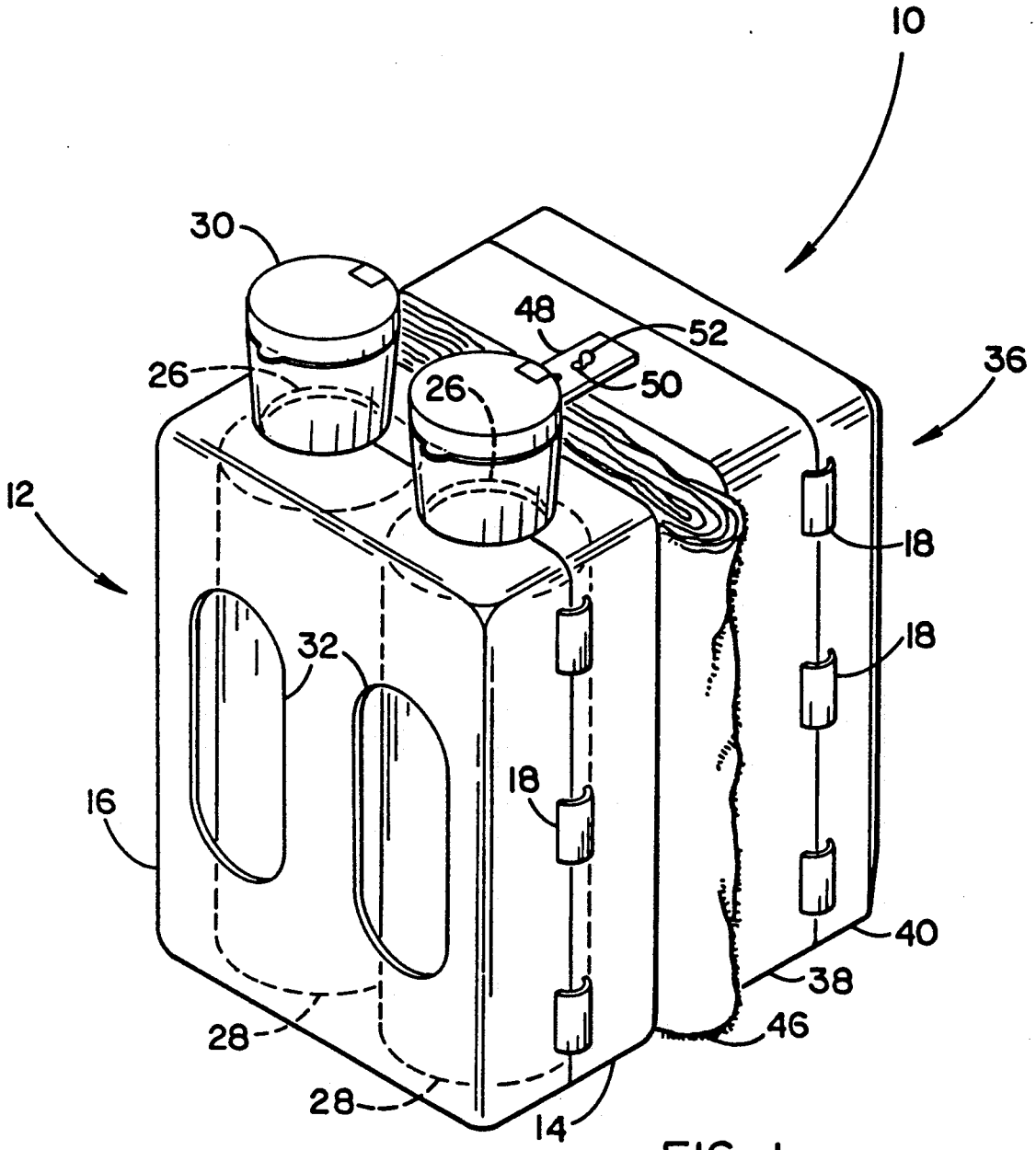
FIG. 1 is a perspective view of the shower kit of the present invention with both its soap and its shampoo container closed, bottle caps projecting from its shampoo container, and a face cloth bound between its containers.

Referring now specifically to the drawings, FIGS. 1 through 6 show the inventive shampoo kit generally designated by reference numeral 10 herein. The kit comprises a pair of hinged, generally-rectilinear containers flexibly attached to one another so that one may be folded over and bound to the other with a face cloth between them.

Kit 10 is preferably of one-piece construction, and made of a flexible, water-impervious material. Many plastics and rubber compounds are expected to suffice.

The first container 12 is comprised of a base shell 14 and a lid shell 16. Shells 14 and 16 are bound together by hinges 18. A plurality of hinges are shown, but a single hinge may also be employed.

For the purpose of holding the shells in a closed, mated relation defining a cavity, a clasp 20 is provided on the mating edge of shell 16 and a post 20 is provided on the mating edge of shell 14. Clasp 20 and post 22 are opposite hinges 18. Clasp 20 grasps post 22, holding the shells together.

Container 12 is adapted to house a pair of tubes or flexible bottles filled with liquid toiletry items, such as shampoo and hair conditioner. For this purpose, the mating edges of shells 14 and 16 at one end of container 12 define a pair of semicircular cutouts. When container 12 is clasped closed as in FIG. 5, these cutouts form circular apertures 26 through which the necks of bottles or tubes may project. As best shown in FIG. 1, the caps 30 of bottles 28 thereby remain exposed, making the bottles' contents accessible.

Container 12 also includes a pair of cutouts defining elongate access holes 32 in lid shell 16, through which bottles 28 may be manipulated or squeezed. In addition, base shell 14 may include a dividing wall 34 to limit movement of bottles 28.

The second container 36 is similar in shape and size to container 12, although it lacks apertures 26 and holes 32. Thus, its base shell 38 and its lid shell 40 include no cutout areas. However, container 34 does include a hinge 18, a clasp 20 and a post 22.

Figure 4:
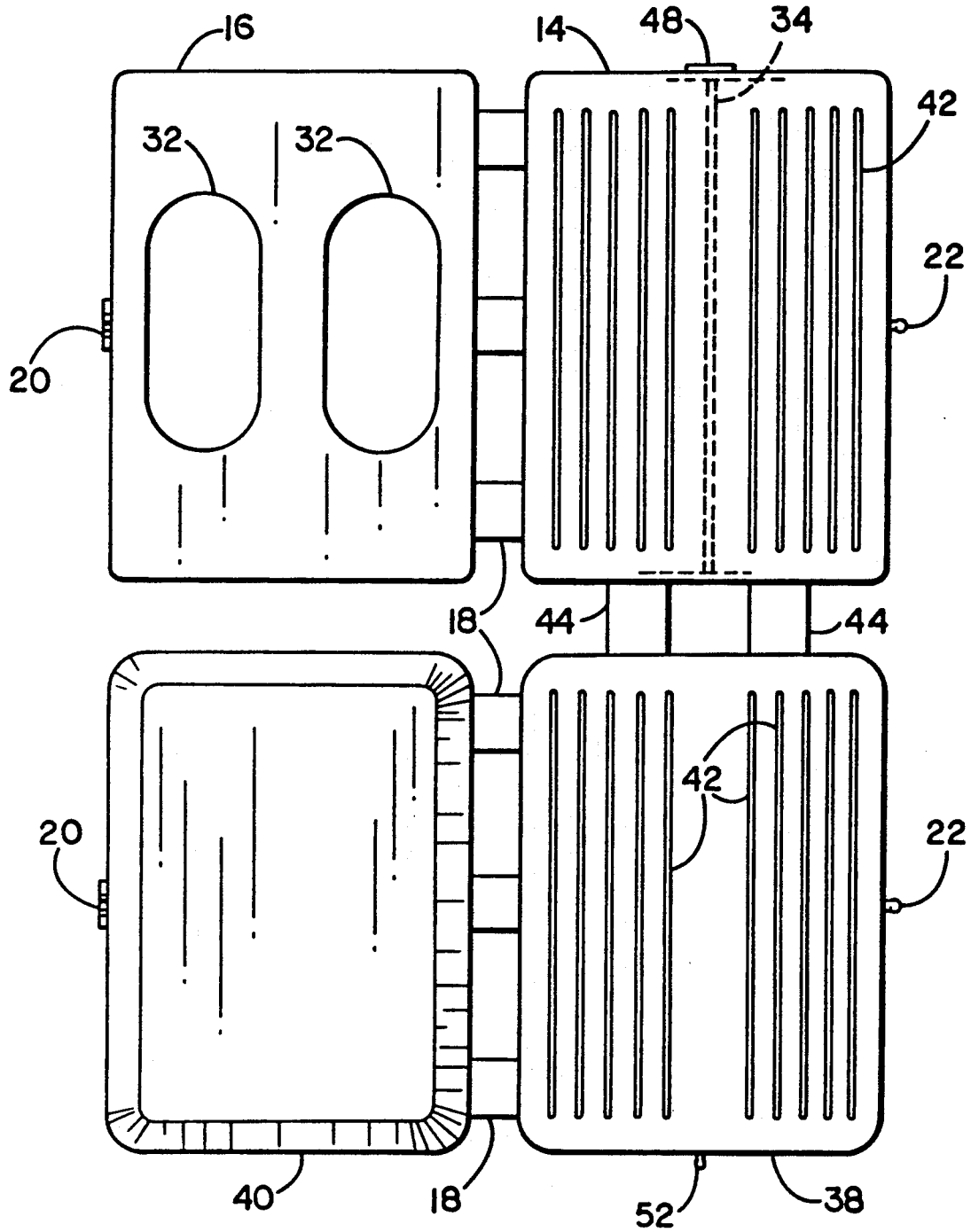
FIG. 4 is a view of the underside of the open kit.

Containers 12 and 36 both include ribs 42 standing out from their base shells (14 and 38), as is best shown in FIG. 4. One purpose of these ribs is to provide structural rigidity. Other advantages of ribs 42 are discussed below.

Containers 12 and 36 are bound to one another by flexible straps 44 between their base shells, 14 and 38, respectively. These are shown in FIGS. 2 through 6. Straps 44 should be of sufficient length such that one container can be folded over the other to bind a face cloth 46 between them, as in FIG. 1.

Means for releasably binding containers 12 and 36 folded together are provided by a belt 48 affixed to base shell 14. Belt 48 includes perforations 50, each perforation being sized and adapted to receive a protrusion 52 from base shell 38. When a folded face cloth 46 is placed between the containers, belt 48 may be hooked over protrusion 52.

In use, kit 10 may initially be laid flat and open as in FIG. 3. Bottles 28 may be placed in base shell 18, on either side of wall 34, with their necks resting in the semicircular cutouts that will mate with same in lid shell 16 to form circular apertures 26. Lid shell 16 is bound closed by aligning clasp 20 with post 22 and pressing them together such that the former grasps the latter. A bar of soap may be placed in container 36, base shell 38 and lid shell 40 also mating with the aid of a clasp 20 and post 22.

Once containers 12 and 36 are closed, they may be folded toward each other such that their base shells 14 and 38 oppose each other. This folded configuration is best shown in FIGS. 1, 5 and 6. A folded face cloth 46 may be placed between shells 14 and 38, straps 44 being long enough to permit the shells to lie parallel to one another while grasping cloth 46. Protrusion 52 may then be guided through one of the perforations 50 of belt 48 such that containers 12 and 36 remain in temporarily fixed relation to one another. At this point kit 10 is packed and ready for use.

In the shower, kit 10 provides all that is needed. The contents of bottles 28 are easily accessible by unscrewing or flipping up their lids. And, delivery of their contents may be aided by squeezing or manipulating them through elongate cutouts 32. Thus, one's hair may be shampooed and conditioned without opening kit 10 further. When needed, cloth 46 is easily removed from between containers 12 and 36 for use with soap from container 36. After use, the soap and cloth may be replaced, the cloth being wet, yet exposed to the air to dry. Ribs 42 projecting from the bottom of shells 14 and 38 aid in grasping cloth 46 to hold it in place, and they also serve to disperse water and promote air circulation around cloth 46 helping it to dry.

The entire kit, when folded up, is easy to carry in the hand as a single unit without touching the wet face cloth. Of course, all manner of hooks and handles are known in the art for aiding in hanging and carrying kit 10, and any of these may be added for further convenience in its use. In addition, drainage holes may be added as needed to keep excess water from standing in the kit between uses.

The foregoing detailed disclosure of the inventive shower kit 10 is considered as only illustrative of the preferred embodiment of, and not a limitation upon the scope of, the invention. Those skilled in the art will envision many other possible variations of the structure disclosed herein that nevertheless fall within the scope of the following claims. And, alternative uses for this inventive kit may later be realized. Accordingly, the scope of the invention should be determined with reference to the appended claims, and not by the examples which have herein been given.

I claim:

1. A article carrying kit comprising, in combination:

a. a first container comprising a mating pair of shells defining a cavity;

b. a second container, similar in size to the first, also comprising a mating pair of shells defining a cavity;

c. at least one flexible member joining said first and second containers such that one of said containers may be folded over the other while leaving sufficient space therebetween for a folded face cloth; and, d. means for releasably binding said containers to one another while maintaining said space therebetween.

2. The kit of claim 1, wherein at least one pair of shells releasably mates with the aid of a hinge.

3. The kit of claim 1, wherein at least one pair of shells releasably mates with the aid of a clasp.

4. The kit of claim 3, wherein said clasp is opposite a hinge.

5. The kit of claim 1, wherein said flexible member comprises at least one strap.

6. The kit of claim 1, wherein said binding means is opposite said flexible member.

7. The kit of claim 1, wherein said binding means comprises a protrusion on one container and a belt on the other, an aperture being defined by said belt for releasably receiving said protrusion.

8. The kit of claim 7, wherein said belt defines a plurality of apertures, thereby being rendered adjustable.

9. The kit of claim 1, wherein said first container defines at least one aperture through which the neck of a liquid-retaining receptacle may project.

10. The kit of claim 9, wherein said aperture is defined by opposing semicircular cutouts at a point where said shells mate.

11. The kit of claim 1, wherein said first container further defines an access hole through which a liquid-containing receptacle may be manipulated.

12. A shower kit of flexible, water-impervious material comprising, in combination:

a. a first container comprising a mating pair of shells having a hinge along one of their mating edges, said shells defining a cavity when mated;

b. a second container, similar in size to the first, also comprising a mating pair of shells having a hinge along one of their mating edges, said shells defining a cavity when mated;

c. at least one flexible strap joining said first and second containers such that one of said containers may be folded over the other while leaving sufficient space therebetween for a folded face cloth; and, d. means for releasably binding said containers to one another while maintaining said space therebetween.

13. The shower kit of claim 12, wherein said kit is of one-piece construction.

14. The shower kit of claim 12, wherein said first and second containers have clasps opposing their hinges for holding said shells in mated relation.

15. The shower kit of claim 12, wherein said binding means comprises a protrusion on one container and a belt on the other, an aperture being defined by said belt for releasably receiving said protrusion.

16. The kit of claim 15, wherein said belt defines a plurality of apertures, thereby being rendered adjustable.

17. The kit of claim 12, wherein said first container defines at least one aperture through which the neck of a liquid-retaining receptacle may project.

18. The kit of claim 17, wherein said aperture is defined by opposing semicircular cutouts at a point where said shells mate.

19. The kit of claim 12, wherein said first container further defines an access hole through which a liquid-containing receptacle may be manipulated.

20. A shower kit of flexible, water-impervious material and of one-piece construction comprising, in combination:

a. a first container comprising a mating pair of shells, said shells defining a cavity when mated, said shells having at least one aperture defined by their mating edges through which the neck of a liquid-retaining receptacle may project, and one of said shells defining an access hole through which a liquid-containing receptacle may be manipulated;

b. a second container, similar in size to the first, also comprising a mating pair of shells, said shells defining a cavity when mated;

c. at least one flexible strap joining said first and second containers such that one of said containers may be folded over the other while leaving sufficient space therebetween for a folded face cloth; and, d. means for releasably binding said containers to one another while maintaining said space therebetween.

* * * * *